United States Patent [19]

Ohta et al.

[11] Patent Number: 4,729,332

[45] Date of Patent: Mar. 8, 1988

[54] MOORING APPARATUS

[75] Inventors: Harutaka Ohta; Kazuchiyo Miyamoto, both of Kanagawa; Arataro Terayama, Tokyo; Seiji Maruhashi; Shigeru Gohdo, both of Kanagawa, all of Japan

[73] Assignee: Nippon Kokan Kabushiki Kaisha, Tokyo, Japan

[21] Appl. No.: 68,443

[22] Filed: Jul. 1, 1987

Related U.S. Application Data

[62] Division of Ser. No. 756,497, filed as PCT JP85/00089, Feb. 26, 1985, published as WO85/05608, Dec. 19, 1985, Pat. No. 4,708,082.

[30] Foreign Application Priority Data

Dec. 21, 1983 [JP] Japan ..... 58-239939
May 31, 1984 [JP] Japan ..... 59-79424[U]

[51] Int. Cl.[4] ..... B63B 21/16
[52] U.S. Cl. ..... 114/230; 114/218
[58] Field of Search ..... 114/218, 230, 251; 441/3, 4, 5; 212/192, 167, 251; 294/119.2, 82.27

[56] References Cited

U.S. PATENT DOCUMENTS 4,082,054 4/1978 Bruner ..... 114/230

FOREIGN PATENT DOCUMENTS 49-4194 1/1974 Japan ..... 114/230

*Primary Examiner*—Sherman D. Basinger
*Assistant Examiner*—Edwin L. Swinehart
*Attorney, Agent, or Firm*—Moonray Kojima

[57] ABSTRACT

A mooring apparatus comprises a mooring bridle 1, a bitting part 2 equipped to the mooring bridle at an end thereof, a mooring winch 3 connected to the mooring bridle at another end, a cable 4 suspending the bitting part, and a crane 5 connected to the suspending cable. When carrying out the mooring operation, the suspending cable 4 is coiled by driving the crane 5 with respect to a bitt or bollard on an opposite vessel or quay and subsequently the mooring bridle is given tension by working the winch 3, and the mooring operation is finished. The winch is located below the crane arm and is disposed to rotate simultaneously with the crane so that the winch always faces the same direction as the arm to prevent twisting of the bridle. When the vessel leaves, the above mentioned operation is performed reversely. Due to the mechanical operation of the above mentioned apparatus, automation, rationalization and safety of the mooring work may be accomplished.

1 Claim, 12 Drawing Figures

MOORING APPARATUS

This is a division of application Ser. No. 756497, filed as PCT JP 85/0089 on Feb. 26, 1985 Published as WO 85/05608 on Dec. 19, 1985, now U.S. Pat. No. 4,708,082.

FIELD OF THE INVENTION

This invention relates to a mooring apparatus which automates mooring of vessel to vessel, or vessel to quay by mechanical operation.

BACKGROUND OF THE INVENTION

The prior art has conventionally carried out mooring operations of vessel-to-vessel, or vessel-to quay using the following procedures;

(1) two or three people position themselves at the stem and stern of a vessel respectively, and a chief manager positions himself at a steering house of the vessel, (2) when a vessel A to be moored comes near to another vessel B (or the quay) as seen in FIG. 2, a rope is thrown to an opposite side from the stern, and the opposite party hauls it (the rope is combined at its end with a mooring bridle 100), (3) when the bridle 100 reaches the opposite side B following the rope, it is combined such as by a knot with a bitt 101 (or a bollard), (4) the bridle 100 is combined with the bitt 101 (or bollard) at its one end and mounted on a winch 102 of the vessel A at its other end, and it is coiled by a required amount, and the work at the stem is finished, (5) the same work is also done and finished at the stern part (in the case of a big vessel, the bridle 100 is also provided at its center besides the stem and stern).

As is seen, the mooring work requires much labor and time. The wire rope is, in general, used for the bridle. The wire rope is easily handled, but it is often broken several times in a year per vessel. The mooring work is very dangerous. Therefore, automation of the mooring operation has been desirous from the view of improving the work and safety of the workmen.

The present invention is to provide a mooring apparatus which automates the above mentioned mooring work by means of mechanical operation.

DISCLOSURE OF THE INVENTION

For accomplishing such an object, the invention is, as shown in FIG. 1, constructed by providing a rotatable crane 5, equipping a bitting part 2 to a mooring bridle 1 at its end portion which is coiled by a winch 3, and connecting a cable 4 suspending the bitting part 2 to the crane 5 so that the bitting part 2 is moved vertically by rotation of the coiling mechanism 53 of crane 5. The bitting part 2 is caught by the bitt or bollard at the opposite vessel or quay.

When carrying out the mooring work, the bridle 1 is loosened by releasing the winch 3, and the crane 5 is rotated with respect to the object bitt and the suspending cable 4 is allowed to go down to a desired position from the crane 5. In this way the bitting part 2 is mounted on the bitt. Subsequently the suspending cable 4 is loosened, while the mooring bridle 1 is coiled up by the winch 3 to effect a tension thereto. Thus the mooring work is accomplished.

When the vessel leaves from the opposite vessel or quay, the bridle 1 is loosened by releasing the winch 3, and the cable 4 is pulled up by the crane 5 to draw back the bitting part 2 from the bitt.

Further, in the invention, the mooring winch 3 is rotated in association with the rotatable crane 5 in order to prevent breaking of the bridle 1 by excessive twisting to be caused when coiling the bridle 1, thereby to enable coiling efficiency.

PREFERRED EMBODIMENT FOR REDUCING THE INVENTION TO PRACTICE

The present invention will be explained with reference to embodiments shown in the attached drawings.

EXAMPLE 1

Figure 1:
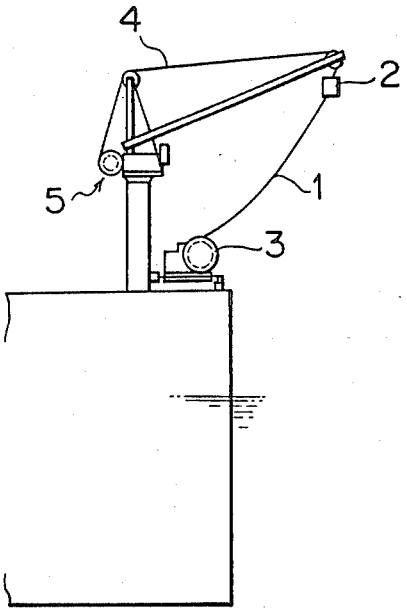
FIG. 1 is an explanatory view showing a structure of the invention.
Figure 3:
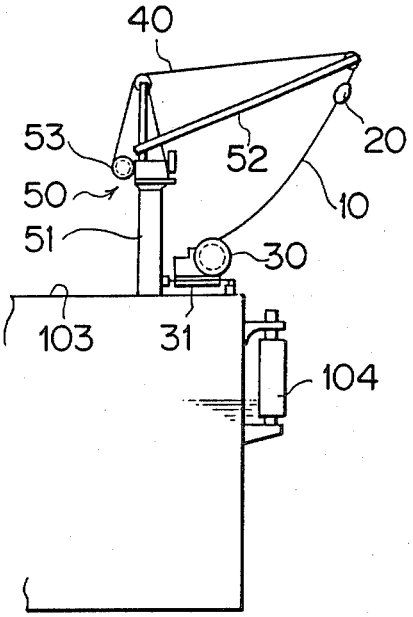
FIG. 3 is an outlined view showing one example of the invention.
Figure 2:
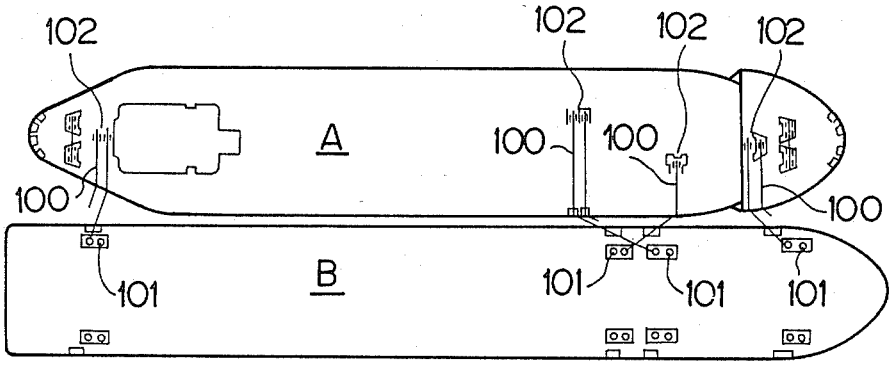
FIG. 2 is an explanatory view showing a mooring procedure of the prior art.

FIG. 3 illustrates a mooring apparatus relating to one embodiment of the invention. In this invention, there are, at a broadside of a vessel, provided a mooring bridle 10, a bitting part 20 equipped to the bridle 10 at its end, a mooring winch 30 connected to the bridle 10 at another end, a cable 40 for suspending the bitting part 20, and a crane 50 connecting the bridle 10.

The mooring bridle 10 is composed of wire ropes and has a bitting part 20 at its end, and mounts the bitting part 20 on a bitt disposed on the object vessel or quay in order to haul itself toward the object.

Figure 6:
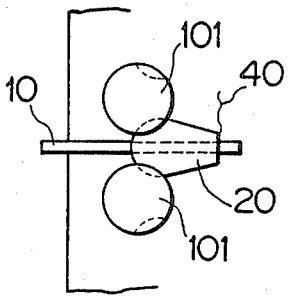
FIG. 6 is an enlarged view showing a bitting part caught between bitts.

The bitting part 20 is like a pear shaped structure, and in the present embodiment the bitting part is like a ball as seen in FIG. 6 so that it is easily caught by spherical parts of the bitt 101.

The mooring winch 30 is connected to the bridle 10 at its end and draws the bridle by winding.

The suspending cable 40 is composed of another wire rope which is also connected with the bitting part 20, and moves the latter 20 upward or downward when it is caught by the bitts 101 or is released therefrom.

The crane 50 has a rotatable mechanism, and is connected with the cable 40 for coiling the bitting part 20 upward or downward. In this embodiment, the crane mechanism is, as shown in FIG. 3, composed of a swingable crane post 51, a vertically movable arm 52 provided at the top of the crane post, and a coiling mechanism 53 which has a winch for coiling the cable 40 upward or downward via a fulcrum at the end point of the arm 52.

The mooring winch 30 may be rotated in association with the rotated crane 50. In this embodiment, as shown in FIGS. 3 and 5, the mooring winch 30 is mounted on a bed 31 which is secured to the crane post 51 and is swingable in relation with the crane post 51 and deck 103, so that the winch 30 is rotated on the deck 103 in accompaniment with the crane post 51 (see arrows in FIG. 5), and the winch 30 and the crane 50 always face in the same horizontal direction.

Figure 4:
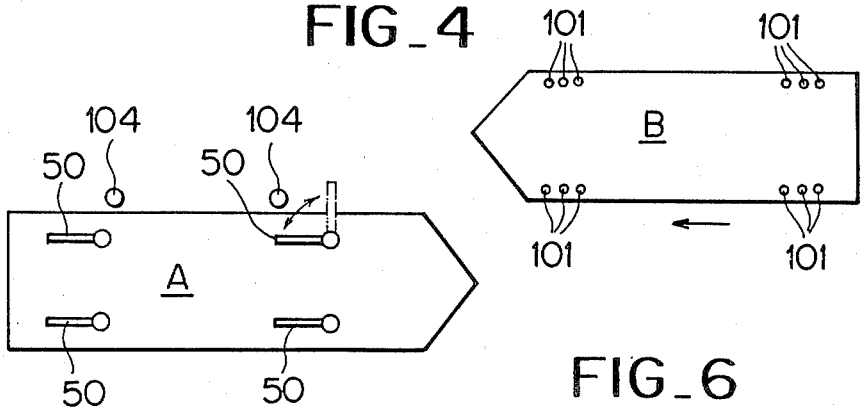
FIG. 4 is a plan view showing an initial mooring procedure of the above example.

An explanation will be made to a mooring operation in dependence upon the above mentioned mooring apparatus. FIG. 4 shows that a dredger A has the present apparatuses of more than two pairs at one broadside thereof, while a soil carrier B approaches which has triple bitts 101 at positions of more than two at one broadside thereof.

Figure 5:
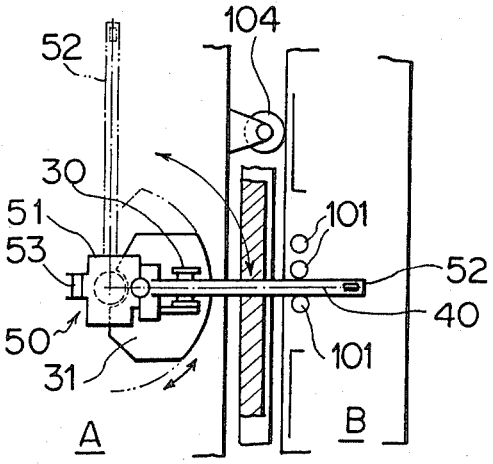
FIG. 5 is a plan view showing a subsequent procedure thereof.
Figure 8:
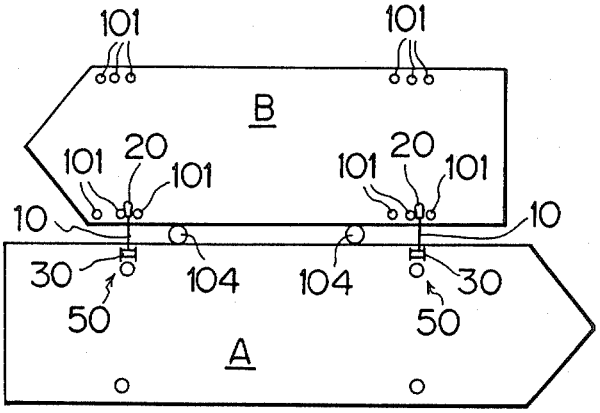
FIG. 8 is a plan view showing the mooring operation finished.
Figure 7:
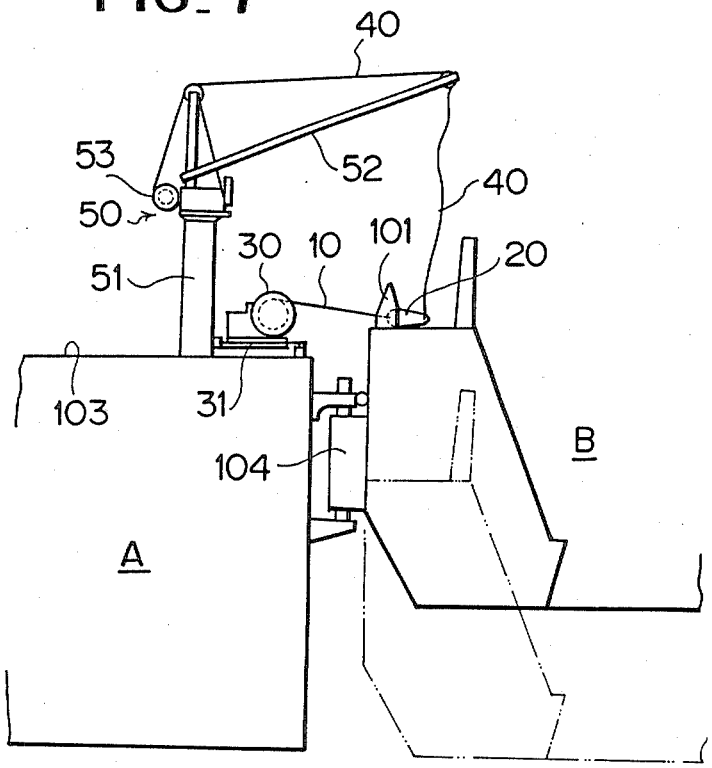
FIG. 7 is an explanatory view showing successive procedures of the above mentioned mooring work.

The crane 50 is rotated as in FIG. 4, and the bitting part 20 is, as shown in FIG. 5, coiled up to a determined height which the soil carrier B does not contact. When the soil carrier B approaches and the triple bitts 101 go within a rotation range of the crane 50, the bitting part 20 is quickly dropped backward of the bitts 101. When the bitting part 20 is completely caught between the bitts 101 and 101 as illustrated in FIG. 6, the bridle 10 is hauled by means of the mooring winch 30 as in FIG. 7. In such a way, the mooring operation is finished at one broadside. Then, the suspending cable 40 is loosened. The same operation is also carried out at another position of the same broadside, and all of the mooring operations are finished as in FIG. 8. The same may be applied to a case of the quay, too.

A numeral 104 in FIGS. 3 to 5, 7 and 8 designates a fender serving as cushioning at mooring.

EXAMPLE 2

Figure 9:
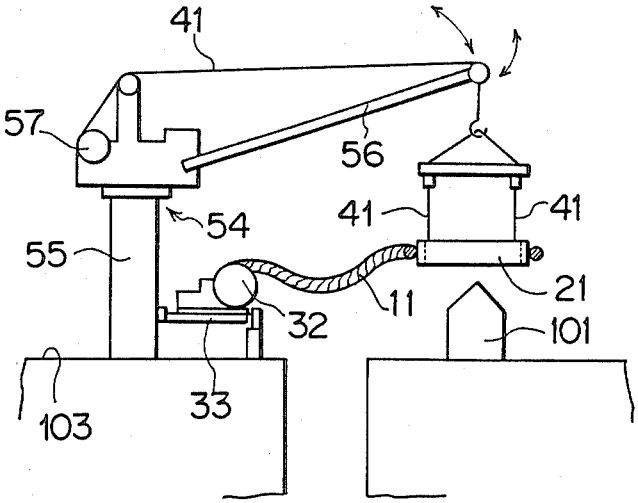
FIG. 9 is an explanatory view showing another example of the invention.

FIG. 9 shows a mooring apparatus relating to another embodiment wherein there are provided, at the broadside, a mooring bridle 11, a bitting part 21 equipped at the end of the bridle 11, a mooring winch 32 connected to the other end of the bridle, cables 41 suspending the bitting part 21, and a crane 54 connecting the suspending cables 41. The bridle 11, the winch 32 and a bed 33 of this embodiment are the same as in EXAMPLE 1, and a crane post 55 of the crane 54, an arm 56 and a coiling machine 57 are also the same as the structure of the aforementioned crane 50 of EXAMPLE 1.

Figure 10:
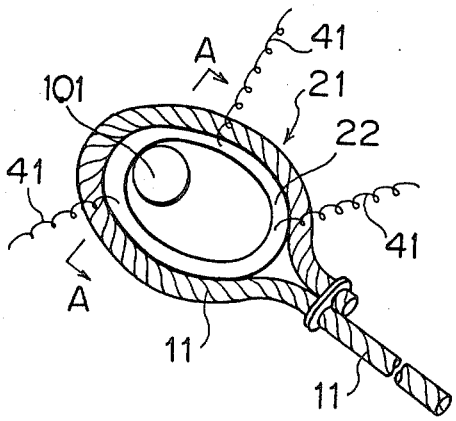
FIG. 10 is an enlarged view showing a structure of the bitting part of the above embodiment.

The bitting part 21 is, as depicted in FIG. 10, obtained by bending the bridle 11 at its end part as eye-splice and attaching a steel ring 22 to an inside thereof, and is served to catch a bitt 101 of the object one.

Figure 11:
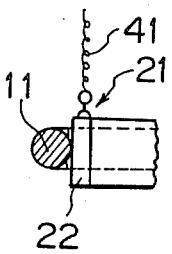
FIG. 11 is a partial, cross sectional view showing the structure of the bitting part.

The cables 41 suspend the bitting part 21, and move vertically it with respect to the bitts 101. Therefore, as seen in FIGS. 10 and 11, the wires 41 are connected to three points on the circumference of the steel ring 22 such that the ring 22 is made horizontal.

Figure 12:
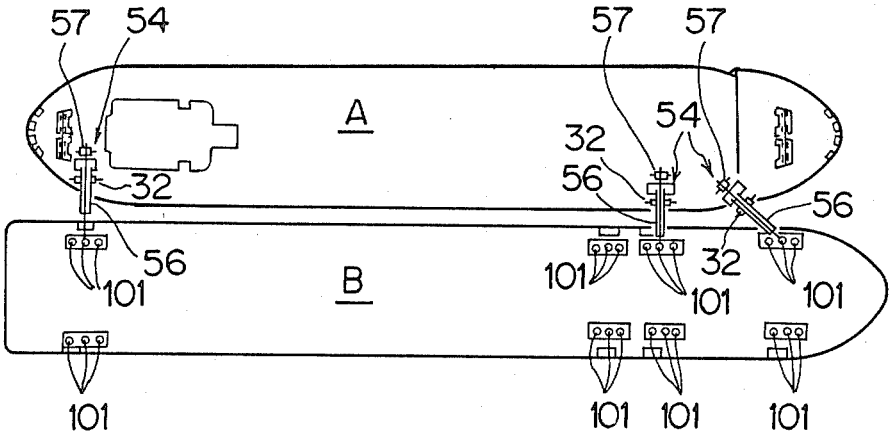
FIG. 12 is an explanatory view showing the mooring procedure of the above example.

A further explanation will be made to a mooring operation in dependence upon the above mentioned apparatus. FIG. 12 shows that a dredger A has the present apparatuses of more than two pairs at one broadside thereof, while the soil carrier B approaches which has triple bitts 101 at positions of more than two at one broadside thereof.

Locating of the first bitting part 21 as well as swinging of the crane 54 are carried out in the same manner as in EXAMPLE 1. When the steel ring 22 of the bitting part 21 is just above the bitt 101, the suspending mechanism 53 positions the bitting parts 21 on the bitt 101. When the former 21 completely catches the latter 101, the mooring bridle 11 is given tension by the winch 32, and the mooring operation is finished at one position of the broadside. Then, the suspending cables 41 are loosened. The same operation is also performed at the other positions of the same broadside, and all of the mooring operations are finished as in FIG. 12.

Also, when the vessel leaves, the mooring bridle 11 is loosened, and the cable 41 is suspended by the suspending mechanism 53 to give tension thereto, and the bitting portion 21 is released from the bitts 101.

INDUSTRIAL APPLICATION OF THE INVENTION

As having mentioned above, the mooring apparatus is to rationalize and automate the mooring operation of vessel-to-vessel or vessel-to-quay, and is to play an important role of securing working safety.

What is claimed is:

1. A mooring arrangement comprising at least two mooring apparatus disposed a selected distance apart from each other on a deck (103) of a moving vessel (A) for mooring the moving vessel (A) to another vessel (B) or a quay having a bitt (101) or bollard at locations opposite to the mooring apparatus, each said mooring apparatus comprising a vertically extending post (51) rotatably anchored to said deck (103) and rotatable in a horizontal plane;

an arm (52) attached to a top of said post and disposed to be horizontally rotatable with said post and independently rotatable in a vertical plane, said arm having a pulley at an end opposite to the attached end for holding a cable (40);

a coiling mechanism (53) attached to said top of said post and holding one end of said cable (40) for coiling said cable (40);

a bitt part (20) connected to the other end of said cable (40) and located below said pulley opposite said coiling mechanism (53), and comprising a geometric structure shaped to fit between or about said bitt or bollard (101) on said other vessel or quay;

a bridle (10) having one end thereof connected to said bitt part (21); and a winch (30) connected to another end of said bridle for tigthening and loosening said bitt part after attachment to said bitt or bollard, said winch being disposed below said arm (52) and connected to said post to be simultaneously rotatable in the horizontal plane with said post and always in the same direction as said arm (2);

whereby to effect mooring, the moving vessel (A) is brought adjacent the other vessel (B) or quay with the at least two mooring apparatus positioned opposite the bitts or bollards on the other vessel or quay, then the post and winch are concurrently rotated in the horizontal plane and the arm is vertically rotated so that the end of the arm having the pulley extends slightly further into the other vessel or quay than the corresponding bit or bollard, then the coiling mechanism runs out the cable until the bitt part is about or within the bollard or bitt while concurrently the winch releases the bridle to allow sufficient length of bridle, and then the winch rolls in the bridle until the bitt part fits securely in or about the bitt or bollard; and whereby to effect dismooring, the winch releases the bridle to allow the bit part ot come off or out of contact with the bitt or bollard, then the coiling mechanism coils the cable and runs up the bitt part vertically to about the point of the pulley located at an end of the arm, and then the post and winch are horizontally rotated so that the arm is within the confines of the vessel;

wherein said bitt part is a pear shaped structure which fits within a pair of bitts located on the other vessel or quay.

* * * * *